United States Patent [19]

Goldbeck et al.

[11] Patent Number: 4,967,675

[45] Date of Patent: Nov. 6, 1990

[54] METHOD AND SEWING UNIT HAVING MEANS FOR FOLDING A STRIP OF MATERIAL PRIOR TO SEWING THE SAME TO A BLANK

[75] Inventors: Heinz Goldbeck, Bielefeld; Herbert Diekmann, Vlotho, both of Fed. Rep. of Germany

[73] Assignee: Durkoppwerke GmbH, Fed. Rep. of Germany

[21] Appl. No.: 361,377

[22] Filed: Jun. 5, 1989

[30] Foreign Application Priority Data

Jun. 7, 1988 [DE] Fed. Rep. of Germany ..... 3819296
Sep. 27, 1988 [DE] Fed. Rep. of Germany ..... 3832669

[51] Int. Cl.[5] ..... D05B 21/00; D05B 35/06; D05B 27/00

[52] U.S. Cl. ..... 112/262.3; 112/104; 112/147; 112/141; 112/114; 112/265.1

[58] Field of Search ..... 112/262.3, 262.1, 121.12, 112/265.1, 104, 147, 141, 148, 150, 303, 311, 121.11, 121.15, 113, 114; 223/38

[56] References Cited

U.S. PATENT DOCUMENTS 4,694,767 9/1987 Beisler ..... 112/147 X
4,787,325 11/1988 Black et al. ..... 112/262.3 X
4,821,659 4/1989 Morii et al. ..... 112/147 X

FOREIGN PATENT DOCUMENTS

3737923-C1 11/1987 Fed. Rep. of Germany .

*Primary Examiner*—Peter Nerbun
*Attorney, Agent, or Firm*—Ostrolenk, Faber, Gerb & Soffen

[57] ABSTRACT

A method and sewing unit for folding a strip of cloth and then transporting it to a sewing machine together with a sewing material blank to which it is to be sewn. In accordance with this invention, the sewing material blank 109, which has been laid out in accordance with markings at a layout point 101 of the sewing unit, together with the strip of cloth 110, are transferred by a feed device 8 to a transfer point 106 beneath the sewing-material holder 9, which has previously been raised. A pivotable and displaceable folding-plate 94 provided on the sewing-material holder, together with a counterplate 54 of the feed device 8, carries out the folding of the strip of cloth 110. Then the folding-plate 94 is pulled forward and the counterplate 54 backward, and the feed device 8 is placed in its raised position. The sewing-material holder 9 moves the folded strip of cloth 110 and the blank 109 lying under it to the sewing point 108 at the sewing machine 3. The feed device 8 is now on its way back to its starting position in the region of the layout place 101.

12 Claims, 9 Drawing Sheets

METHOD AND SEWING UNIT HAVING MEANS FOR FOLDING A STRIP OF MATERIAL PRIOR TO SEWING THE SAME TO A BLANK

BACKGROUND OF THE INVENTION

The present invention relates to a method and sewing unit for folding a strip of cloth which is subsequently to be sewn onto a blank, both workpieces having previously been laid out, prior to the folding, at a layout position near a sewing machine, and then transported to the sewing machine. It relates further to a sewing unit for carrying out the method.

A device for combining a pocket trim strip and a pocket bag to make a trouser pocket is disclosed in European Unexamined Patent No. OS 0 238 980. This and all other prior art materials cited herein are incorporated by reference.

With this device, a folded cloth edge of the pocket trim can be sewn by means of a sewing machine onto the pocket bag consisting of lining fabric. The known device consists essentially of a frame with a work table, a sewing machine arranged approximately centrally thereon, a sewing-material conveyor arranged, as seen in the direction of transport of the material to be sewn, in advance of and immediately adjacent the sewing point, and a folding device alongside the sewing machine conveyor but further removed from the sewing point.

A pocket bag blank is laid out suitably for sewing in accordance with corresponding markings at a layout point, which is the designation for the area of the work table which is in the immediate vicinity of the folding device. A folding-plate of the folding device is then lowered onto the pocket bag blank and clamps it firmly to the work table. A pocket-trim blank with the front side facing downward is now placed in accordance with corresponding markings on the folding-plate, protruding with its longitudinal sides beyond the folding-plate on both sides.

A hold-down plate of the folding device is thereupon lowered onto the upper, protruding region of the pocket trim blank and thus clamps it firmly to the pocket bag blank, the hold-down plate—as seen from the position of the operator—being located behind the folding-plate. The folding-plate is now lifted slightly and then displaced horizontally toward the rear, i.e. away from the operator, whereby the strip of pocket trim, which is now pressed onto the pocket bag only by the hold-down plate, is folded around the front edge of the hold-down plate by the folding-plate which is being displaced rearward. The folded part of the pocket-trim strip now lies with the front side up and is held in clamped position between the folding-plate and the hold-down plate.

The sewing-material conveyor is thereupon displaced opposite the direction of transport of the material to be sewn, so that it is located above but upstream from the folding device. Thereupon the sewing material clip forming part of the sewing material conveyor is lowered onto the folded pocket-trim strip and the hold-down plate below it, which is now pulled out rearward by horizontal movement. Thus only the sewing material clip still presses against the folded pocket-trim strip and the pocket bag and subsequently conveys both to the sewing point of the sewing machine.

From the description just given, a substantial disadvantage of the known device can be noted, which resides in the fact that the layout point is occupied for too long a period of time, during both the folding process which also takes place there and further the process of being taken up by the sewing-material conveyor. The layout point can be utilized only relatively late in the entire work cycle for laying out the next two parts which are to be subsequently sewn. Thus, it is not possible to simultaneously sew two sewing parts, while laying out two further parts which are to be sewn next. Thus, the total cycle time is excessive. Furthermore, the known device has the disadvantage inherent in the method that the unfolded edge of the pocket-trim strip cannot be aligned congruently with the corresponding edge of the pocket bag when both parts are laid out.

Also known, from printed publication SpP 2358-a-0279--Ti-1 of Kochs Adler AG, which has been available to the public, is an automatic machine for sewing on pockets—shown as the sewn-on pockets on shirts, blouses or jackets or the sewn-on back pockets on trousers—in which the blank of a pocket to be sewn on is laid out suitably for sewing at a layout point on an upper plate and the main part of the material to be sewn is laid out suitably for sewing on a further lower plate. By a temporary movement of both separately arranged plates, both parts to be sewn are simultaneously brought to a transfer point, the main part of the material to be sewn being placed directly on the work table and the pocket blank being introduced into a folding device located above the transfer place which is in its open position. The pocket blank is folded on three sides and then lowered onto the main part of the material to be sewn. The sewing process then commences. This known automatic machine for sewing on pockets does not make it possible to bring the main part of the material to be sewn, together with the pocket blank, from the layout place to the transfer place while in a stacked arrangement.

SUMMARY OF THE INVENTION

In view of the foregoing disadvantages of the prior art, it is the principal object of the invention to provide a method in which the folding of the strip of cloth takes place close to the sewing place, thereby making the layout place available for laying out the two workpieces to be sewn next.

Another object is to create a sewing unit for carrying out the method.

These objects are achieved by a method and sewing unit for folding a strip of cloth and then transporting it to a sewing machine together with a sewing material blank to which it is to be sewn, as disclosed and claimed herein.

Advantageously, a method of folding a strip of cloth in position for subsequently being sewn on a blank, comprises the steps of:

laying out both parts to be sewn in accordance with markings, prior to the folding, at a layout place upstream from a sewing machine, with respect to the direction of transport of the material to be sewn;

after the layout, bringing the blank and the unfolded strip of cloth, which partially contact each other, in fixed association with each other and with the front side of the strip of cloth facing upward, from the layout place to a transfer place, by means of a feed device, and locating the feed device below a raised sewing-material holder which is disposed at said transfer place;

lowering the sewing-material holder onto the strip of cloth, the blank, and a counterplate of the feed device;

raising the strip of cloth from the blank and folding an edge region of the strip of cloth downward by the cooperation of a folding-plate of the sewing-material holder with the counterplate;

lowering the folded strip of cloth again onto the blank;

removing the counterplate and the folding-plate from the folded strip of cloth;

transporting the feed device from the transfer place to the layout place; and transporting the sewing-material holder from the transfer place to a storage place.

A sewing unit for carrying out the foregoing method advantageously comprises:

a frame with a work table fastened thereon;

a sewing-machine, a sewing drive, and a marking device for guiding the laying out of the parts to be sewn in a manner suitable for sewing, attached to said work table;

means for fixing the position of the laid out parts to be sewn with respect to each other for folding the strip of cloth and for holding the folded strip of cloth and the underlying blank together and transporting the same to a place for sewing, and then to a storage place. Preferably said means comprises a feed device, which can be moved by a first linear drive along a first guide rod from said layout place to said transfer place, and said feed device includes a horizontally and vertically moveable counterplate and with a clamping unit which can be moved in synchronism with the latter about an axis which is parallel to said first guide rod. The feed device may also comprise a sliding carriage, a beam moveable horizontally with respect thereto, and a carrier moveable vertically with respect to said beam, the counterplate being attached to the carrier via two extension arms.

Said means preferably also comprises a carriage, which can be moved by means of a second linear drive along a third guide rod, and a sewing-material holder connected thereto and raisable and lowerable by a pivotable driver on said carriage, and a folding-plate which is arranged on the sewing-material holder and movable to an upper position, a lower position, and a back position. The sewing-material holder may also comprise a rail, a supporting beam displaceable relative to said rail, and the folding-plate which is mounted pivotally on two levers, each lever being, in turn, pivotable on one transverse side of the supporting beam.

The first linear drive may include a long-stroke cylinder which is mounted fixed on the frame, is actuatable by a pressure fluid, and is operatively connected to the feed device via a driven member; and the second linear drive may include a traction transmission, which is operatively connected to the sewing drive, and a second long-stroke cylinder which is mounted fixed on the frame and is actuable by a pressure fluid, the carriage being driven alternatively by the traction transmission and the long-stroke cylinder.

Alternatively, the first linear drive may include a traction transmission driven by a motor, the traction transmission being operatively connected to the feed device; and the second linear drive may include a further traction transmission driven by a further motor, this traction transmission being operatively connected to the carriage. The motors may be frequency-controlled gear motors or stepper motors.

The sewing unit may also comprise a clamp which is actuatable by an external force and which is provided on the carriage for releasably coupling the carriage to the traction transmission; and a driven member by which the carriage is operatively connected to the long-stroke cylinder.

In accordance with this invention, the sewing material blank 109, which has been laid out in accordance with markings at a layout point 101 of the sewing unit, together with the strip of cloth 110, are transferred by a feed device 8 to a transfer point 106 beneath the sewing-material holder 9, which has previously been raised. A pivotable and displaceable folding-plate 94 provided on the sewing-material holder, together with a counterplate 54 of the feed device 8, carries out the folding of the strip of cloth 110. Then the folding-plate 94 is pulled forward and the counterplate 54 backward, and the feed device 8 is placed in its raised position. The sewing-material holder 9 moves the folded strip of cloth 110 and the blank 109 lying under it to the sewing point 108 at the sewing machine 3. The feed device 8 is now on its way back to its starting position in the region of the layout place 101. Since the folding of the strip of cloth 110 does not take place in the region of the layout point 101, the layout point is available relatively early during the current work cycle for laying out the next blank 109, in accordance with markings, for sewing in the next work cycle. The invention is also usable to fold a pocket-trim strip 104 and sew it to a pocket-bag blank 102.

With the method and sewing unit of the invention it is now possible to carry out the folding of a strip of cloth by means of the sewing-material holder which is present at the transfer place directly in front (that is, upstream) of the sewing place—as seen in the direction of the transport NV of the material to be sewn—in cooperation with the feed device which, at this time, is located beneath the sewing-material holder. With this arrangement, the operator has sufficient time, during the course of a given sewing process, to lay out the two parts to be sewn in the following sewing process, in accordance with the guide markings at the layout place.

It is a further advantage of the inventive solution that the strip of cloth which is to be folded can be deposited at the layout place with its front side facing up, whereby congruent alignment of a longitudinal edge of the strip of cloth with the corresponding edge of the blank is possible.

Other objects, features and advantages of the present invention will be understood from the following detailed description of embodiments thereof.

DETAILED DESCRIPTION OF EMBODIMENTS OF THE INVENTION

General Feature

Figure 1:
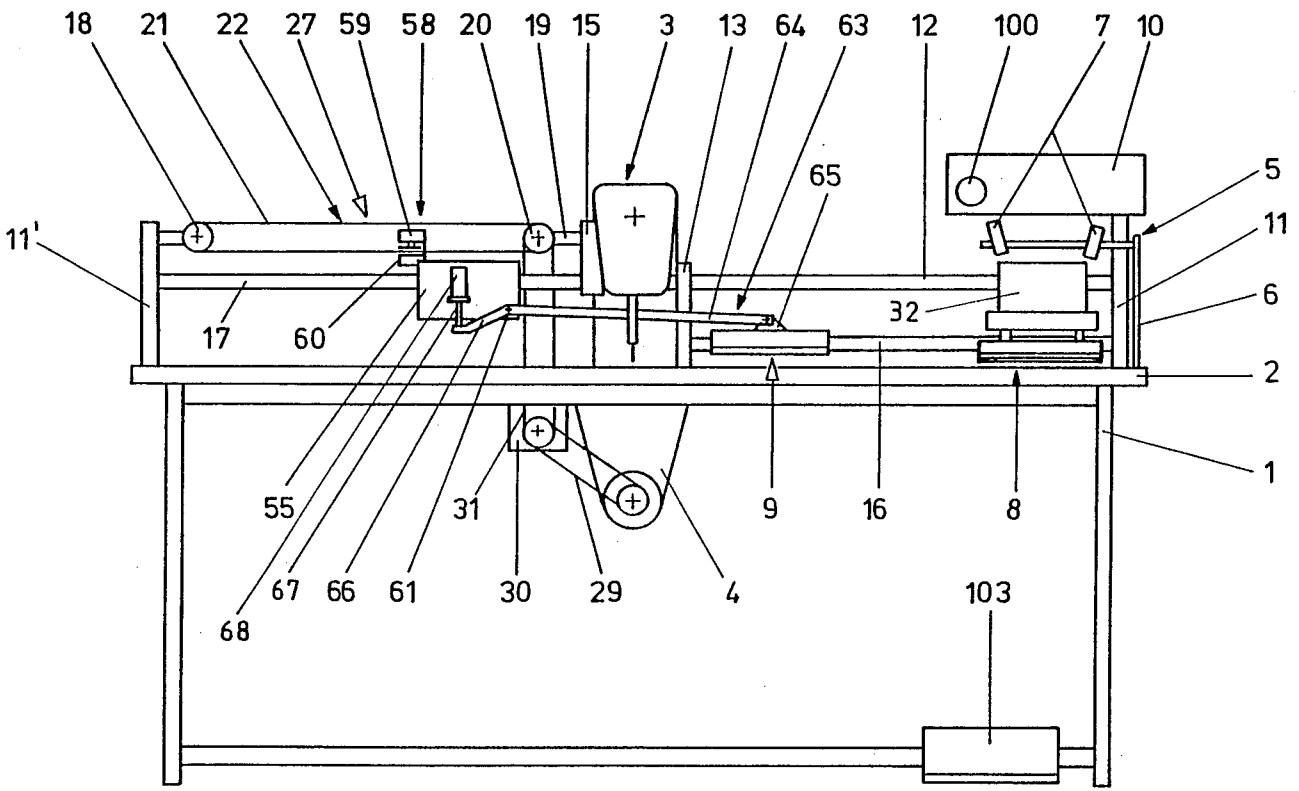
FIG. 1 is a simplified front view of the sewing unit.
Figure 2:
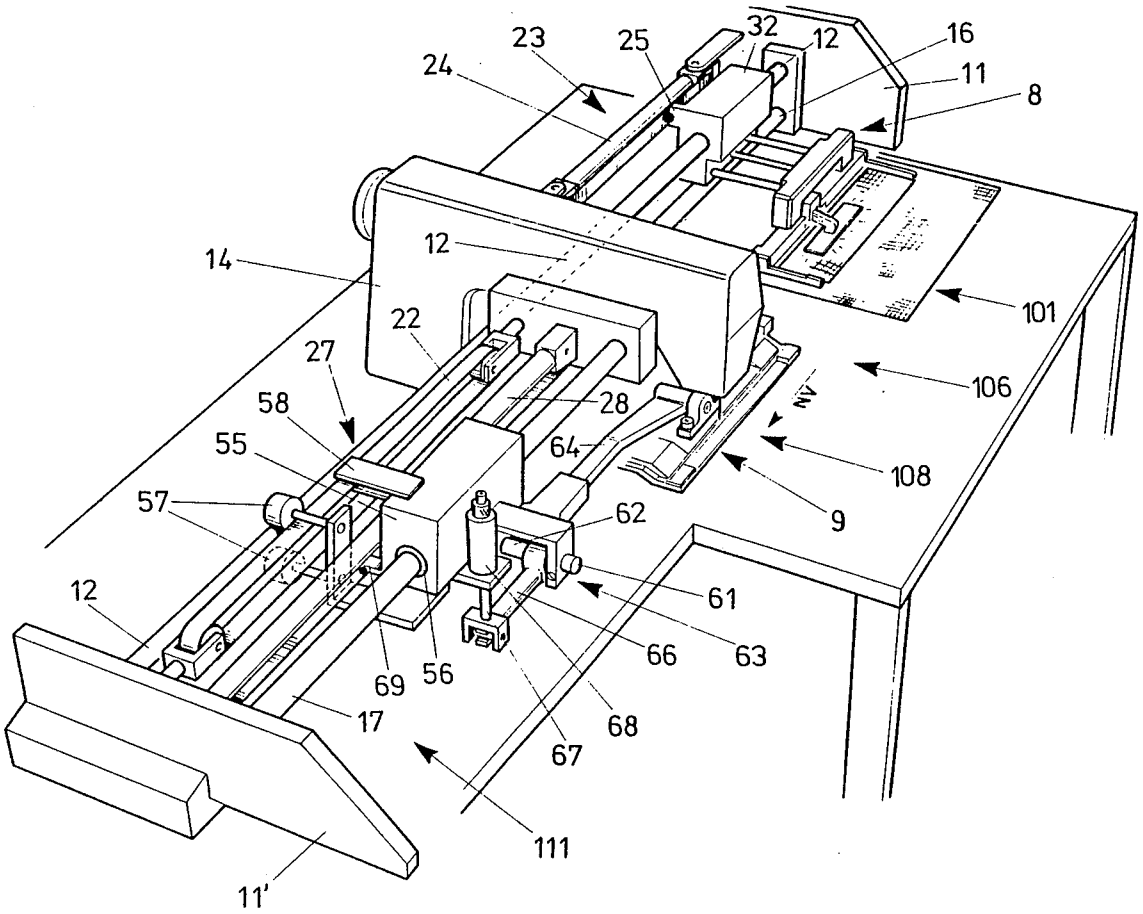
FIG. 2 is a simplified perspective view of the sewing unit.

FIGS. 1 and 2 show the construction of the sewing unit according to an embodiment of the invention, which comprises essentially the following components: a frame 1 with a work table 2 fastened thereon, an industrial sewing machine 3 of conventional construction attached to the worktable, a sewing drive 4 provided below the work table 2 and adapted in known manner to function as a positioning drive, a marking device 5 which is connected to the work table 2 via a stand 6 and has several marking lights 7, a feed device 8, a sewing-material workpiece holder 9 and an electropneumatic control 10.

Two extension arms 11, 11' are rigidly connected to the work table 2 near its transverse sides, a first guide rod 12 being mounted in said extension arms and extending over the entire length of the work table 2 parallel to the direction of transport NV of the material to be sewn. The first guide rod 12 is also supported by a bearing pedestal 13 attached to the sewing machine 3 and a carrier 15 likewise attached to the arm 14 of the sewing machine 3. A second guide rod 16 which extends below the guide rod 12 and parallel thereto is mounted in the extension arm 11 and in the bearing pedestal 13. Between the extension arms 11' and the carrier 15 there is mounted a third guide rod 17 which also extends parallel to the guide rod 12 and is located, as shown in FIG. 2, in front of the guide rod 12, that is, in the direction toward the operator.

A toothed-belt pulley 18 is rotatably mounted on the extension arm 11' in known manner and a further toothed-belt pulley 20 is likewise mounted on a pedestal 19 attached to the carrier 15. Both toothed-belt pulleys 18, 20 have a toothed belt 21 wrapped around them and form together with the latter a traction transmission 22.

Feed Device

Figure 4:
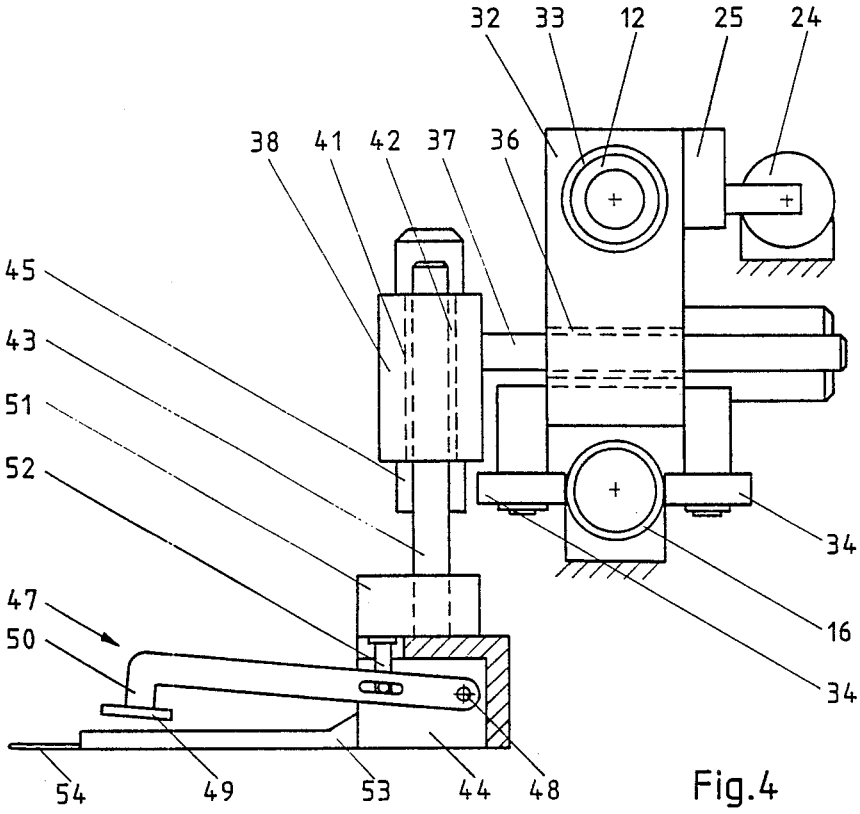
FIG. 4 is a side view of the feed device.

As can be noted from FIG. 2, a first linear drive 23 is arranged in known manner fixed on the frame behind the guide rod 12, the linear drive comprising in one preferred embodiment a first double-acting long-stroke cylinder 24 which is actuable by pressure fluid. The piston movement of the cylinder 24 can be transmitted via a belt-shaped traction means toward the outside and therefore outside the cylinder space. Such a long-stroke cylinder 24 is disclosed in German Patent No. 29 39 153, so a detailed description can be dispensed with here. As shown in FIGS. 2 and 4, the feed device 8 is connected via a driven member 25 to the traction means of the long-stroke cylinder 24.

In alternate embodiments, the linear drive 23 may also comprise a known traction transmission—for instance a toothed-belt transmission—which may be driven either by a frequency-controlled gear motor or by a stepping motor, for example.

In the vicinity of the third guide rod 17, is a second linear drive 27 which in one preferred embodiment comprises the traction transmission 22 and a second single-acting long-stroke cylinder 28, for example pneumatic, which is actuable by a pressure fluid, the transmission 22 and the cylinder 28 being alternately activated in a manner described further below. The long-stroke cylinder 28 is otherwise similar in construction—aside from the different pneumatic action—to the previously described long-stroke cylinder 24.

In alternate embodiments of the linear drive 27, the traction transmission 22 may be driven either by a frequency-controlled gear motor or by a stepping motor, for example.

As shown in FIG. 1, the traction transmission 22 is driven by the sewing drive 4 attached below the work table 2, by means of an interposed first toothed-belt drive 29, a speed reduction gear 30, and a second toothed-belt drive 31. A similarly constructed drive is described in German Patent No. 34 04 758, so a detailed description can be dispensed with here.

Figure 3:
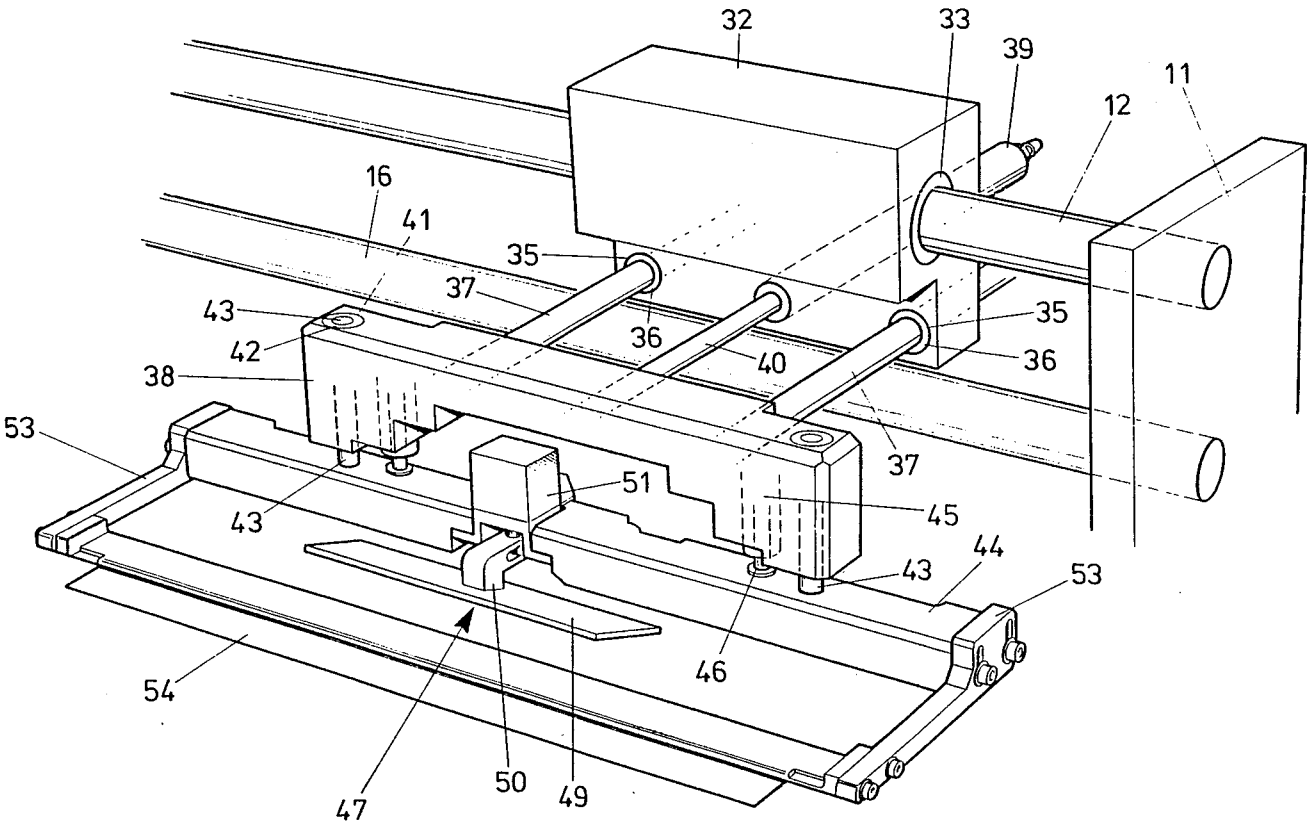
FIG. 3 is a perspective view of the feed device 8.

A sliding carriage 32 is displaceably mounted on the part of the guide rod 12 which, as seen in FIGS. 1 and 2, extends upstream from the sewing machine 3, that is, toward its right side, as seen by the operator, the sliding carriage being a basic component of the disclosed feed device 8. It is equipped with commercially available slide bushings 33 as shown in FIGS. 3 and 4. Thus, the sliding movement of the sliding carriage 32 takes place almost free of friction. Two rollers 34—preferably commercially available anti-friction bearings—are, in accordance with FIG. 4, rotatably mounted on the sliding carriage 23, the rollers rolling on the second guide rod 16 and thus making it possible to displace the sliding carriage 32 while securing it against turning. Two bore holes 35 are provided in the sliding carriage 32 perpendicular to the guide rod 12, further slide bushings 36 being pressed also into said bore holes. The slide bushings receive two sliding rods 37 which are fastened in a beam 38 located in front of the sliding carriage 32. A double-acting compressed-air cylinder 39 is also provided in the sliding carriage 32, as seen in FIG. 3, the piston rod 40 of which is form-locked at its free end with the beam 38. Two bore holes 41 are provided in the beam 38 which extend perpendicular to the sliding rods 37. In the bore holes 41 where are also provided slide bushings 42 in which two rods 43 are displaceably mounted according to FIG. 3. The rods 43 are rigidly connected to a carrier 44. According to FIG. 3, two double-acting compressed-air cylinders 45 are attached to the beam 38, the piston rods 46 of said cylinders being attached at their free ends to the carrier 44.

In accordance with FIG. 4, a clamping unit 47 is mounted in the carrier 44 so as to be pivotable about an axis 48 which extends parallel to the guide rod 12. The clamping unit 47 comprises a clamping plate 49 and an arm 50 rigidly connected thereto. In accordance with FIGS. 3 and 4, a double-acting compressed-air cylinder 51 is attached to the carrier 44, the piston rod 52 of said cylinder being form-locked at its free end in known manner to the arm 50. A counterplate 54 is furthermore attached to the carrier 44 via two extension arms 53.

Sewing Material Holder

Now referring again to FIGS. 1 and 2, a carriage 55 is mounted displaceably on the third guide rod 17, via slide bushings 56 provided in it. Two rollers 57—preferably commercially available anti-friction bearings—are furthermore rotatably mounted on the carriage 55 and roll on the first guide rod 12, in the region shown in FIG. 2 to the left alongside the sewing machine 3, which makes it possible to secure the carriage 55 against turning during its movement. A clamp 58 which can be actuated by a pressure medium or magnetically, for example, is also provided on the carriage 55. When the pressure medium or the electromagnet, as the case may be, acts on the clamp 58, the clamp creates a force-locked connection between the carriage 55 and the traction transmission 22. In this embodiment, the clamp 58 is activated by the action of a pressure medium, and comprises a compressed-air cylinder 59 attached to the carriage 55 and a clamping plate 60 also attached to the carriage 55.

A protruding bearing pin 62 pressed into the carriage 55 forms a pivot point 61. The axis of rotation which passes through the pivot point 61 extends perpendicular to the third guide rod 17.

A driver 63 is pivotally mounted on the bearing pin 62 via a bearing eye in the driver 63, the driver 63 being secured against unintentionally moving away from the bearing pin 62 by holding means.

Figure 6:
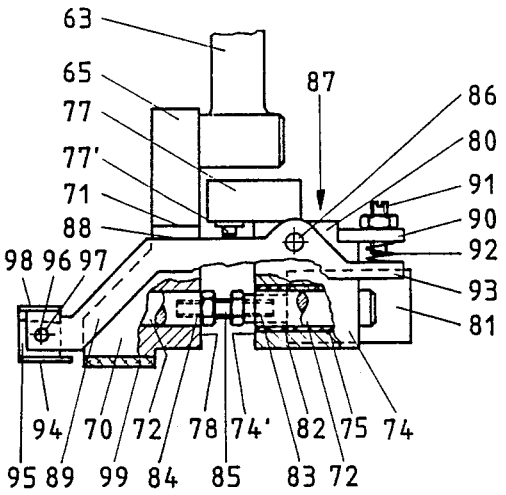
FIG. 6 is a side view of the sewing-material holder.
Figure 5:
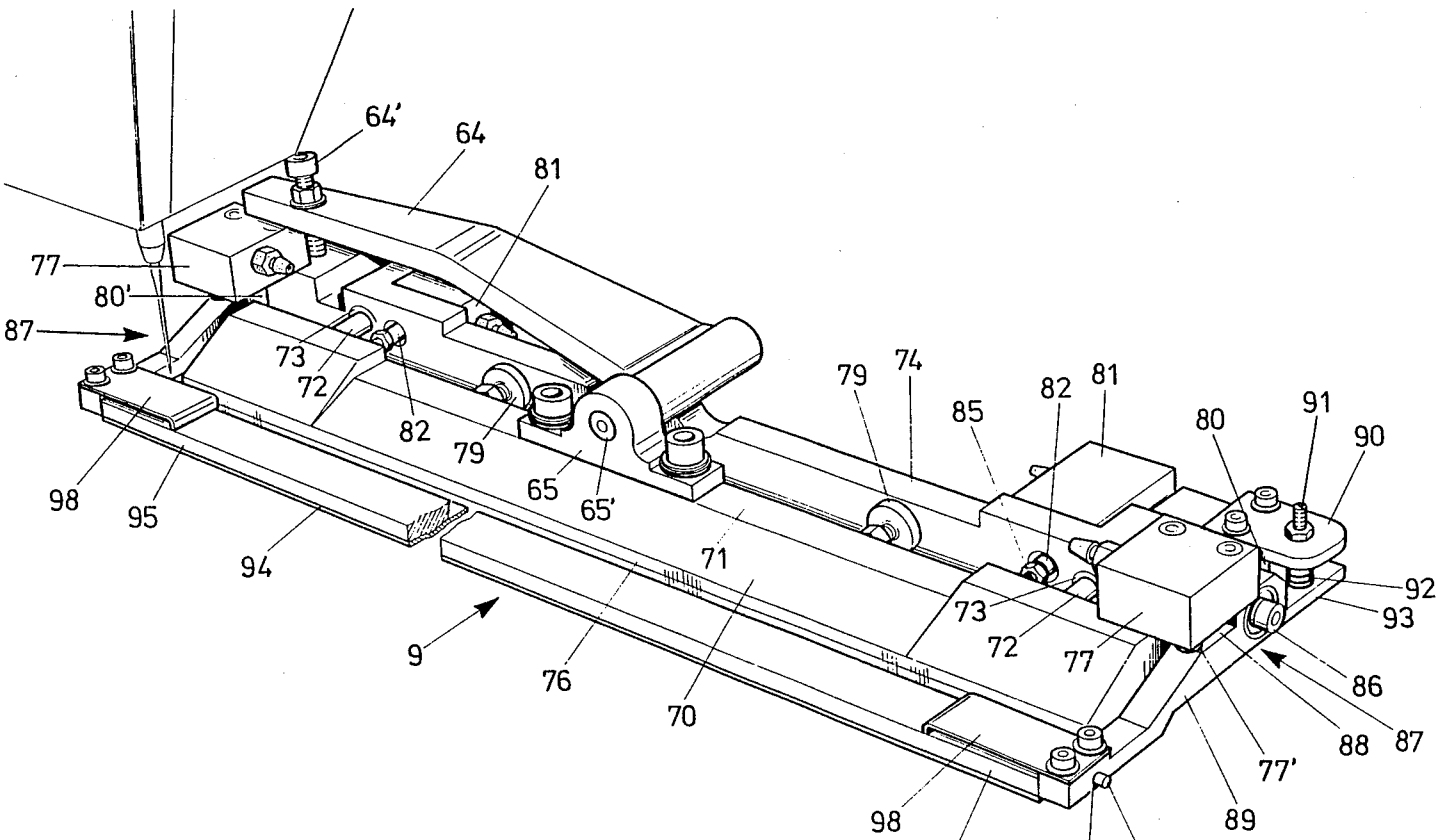
FIG. 5 is a perspective view of the sewing-material holder 9.

Now refer to FIGS. 5 and 6, in addition to FIGS. 1 and 2. The driver 63 is formed in this embodiment as a two-armed lever, a first arm 64 of which is mounted in an articulated manner via a bolt 65' in a bearing pedestal 65 provided on the sewing-material holder 9. A retaining washer (not shown here) is placed on the bolt 65', preventing unintentional detachment of this articulation. The bolt 65' extends perpendicular to a front edge 76 of a rail 70. In accordance with FIG. 5, a setting screw 64' is provided in the arm 64, the setting screw limiting the swinging movement of the sewing material holder 9 about the bolt 65'.

A second arm 66 of the driver 63 receives a piston rod 67 at its free end in form-locked manner, according to FIG. 2. The piston rod forms part of a double-acting compressed-air cylinder 68 which is fastened in known manner on the carriage 55 and is thus arranged between the carriage 55 and the arm 66.

In accordance with FIG. 2, the carriage 55 is connected via a driven member 69 to the traction means of the long-stroke cylinder 28.

The sewing-material holder 9, which is suspended pivotally on the driver 63, comprises the rail 70, on the top side 71 of which there is provided the centrally arranged bearing pedestal 65. One sliding rod 72 is provided on each of the two ends of the rail 70, each sliding rod being rigidly connected to the rail 70. A supporting beam 74 is displaceably mounted to the sliding rods 72 via commercially available slide bushings 73, the slide bushings 73 being pressed into the supporting beam 74. The bearing bore holes 75 provided in the beam 74 extend furthermore perpendicular to the front edge 76. On top of each of the two ends of the supporting beam 74 there are fastened respective single-acting compressed-air cylinders 77, each of which, in accordance with FIG. 5, extends beyond the respective end of the supporting beam 74.

According to FIG. 5, two adjustable stop screws 79 are provided on a rear side 78 of the rail 70, the positions of said stop screws being secured by respective lock nuts, whereby the sliding motion on the sliding rods 72 of the supporting beam 74, which is directed toward the rail 70, can be limited.

In the vicinity of the transverse sides 80, 80' of the supporting beam 74, on its rear side, there are fastened two double-acting compressed-air cylinders 81, the piston rods 82 of which extend parallel to the sliding rod 72. Each piston rod 82 is provided on its front end with a threaded bore hole 83. Another threaded bore hole 84 is arranged opposite each bore hole 83 in closely aligned position on the rear side 78 of the rail 70. In accordance with FIG. 6, the threaded bore hole 84 receives the threaded bolt 85 and its position is secured by a lock nut (FIG. 6).

The piston rod 82 of each compressed-air cylinder 81 is arranged radially rotatably in said cylinder about the long axis of said piston rod 82, and has two parallel surfaces (not shown) on its front end. As seen in FIG. 6, said front ends extend beyond a front side 74' of the supporting beam 74. Thus, each piston rod 82 can be screwed onto the threaded bolt 85 by using a conventional open-end wrench on said parallel surfaces, and can be secured in position by tightening a further lock nut. By screwing on the piston rod 82 in the manner which has just been described, the rail 70, which is not displaceable parallel to the direction of transport NV of the sewing material workpiece, comes into operative engagement with the displaceable supporting beam 74. By loosening the corresponding lock nut and rotating the piston rod 82 with respect to the threaded bolt 85, the limit of the sliding motion of the supporting beam 74 can be changed. This enables the position of a folding-plate 94, relative to the front edge 76 of the rail 70, to be adjustable as described further below.

A pressed-in protruding pin 86 is provided on each transverse side 80, 80' of the supporting beam 74, a two-armed lever 87 being pivotally mounted on said pin. The lever 87 is secured, for example by a retaining washer placed on the pin 86, against unintentional removal from the latter. The previously described compressed-air cylinder 77, which is fastened to the rail 70, is positioned so that the end of its piston rod 77' presses, according to FIG. 6, against an upper side 88 of a longer arm 89 of the two-armed lever 87.

One abutment 90 is attached in the vicinity of each of the transverse sides 80, 80', the abutment receiving an adjustable stop pin 91, the position of which is secured by a lock nut and which limits the rotation of the lever 87. A compression spring 92 is arranged on the part of the stop pin 91 which extends beyond the abutment 90, the compression spring being thus arranged between a shorter arm 93 of the lever 87 and the abutment 90.

On the bottom side of the rail 70 there is provided a covering strip 99, one longitudinal edge of which extends flush with the front edge 76, and the pressure side of which is provided with a surface of good gripping capacity.

Folding Plate

On the free ends of the arms 89 there is provided the folding-plate 94 which, as best seen in FIG. 6, is rigidly connected to an angle 95. In accordance with FIGS. 5 and 6, the latter receives on each of its transverse sides one pressed-in, protruding bearing pin 96 which is in turn received by a hole 97 provided in the arm 89. In this way, the folding-plate 94 is mounted pivotally on both of the arms 89 of the levers 87. The pivoting of the folding-plate 94 is limited by two angular leaf springs 98 which are fastened, according to FIGS. 5 and 6, by fastening means on the top sides of the corresponding arms 89, namely in the vicinity of their free ends.

Pneumatic Supply

The action of the compressed air on all compressed-air cylinders mentioned in the present specification is effected via conventional electro-pneumatic components, such as solenoid valves, throttle valves or the like, which for reasons of simplification have not been described and shown here in detail. The pressure medium is supplied by a common external source of compressed air. The operationally proper time and duration for the action on each compressed-air cylinder is controlled by the electro-pneumatic control 10, in a manner which will be understandable to one having ordinary skill in the art. It should finally also be mentioned that in order to avoid collisions, limit switches can be provided in a manner known per se, which, for reasons of simplification, have not been shown or described separately here, since they are not essential to the invention.

Operation

Figure 15:
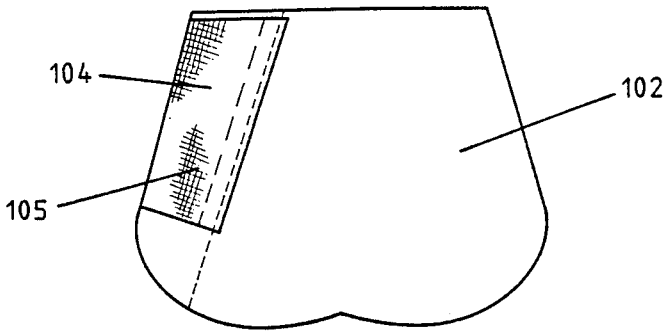
FIG. 15 shows one possible use of the invention, to make a pocket bag blank 102 with a folded and sewn-on pocket-trim strip 104.
Figure 16:
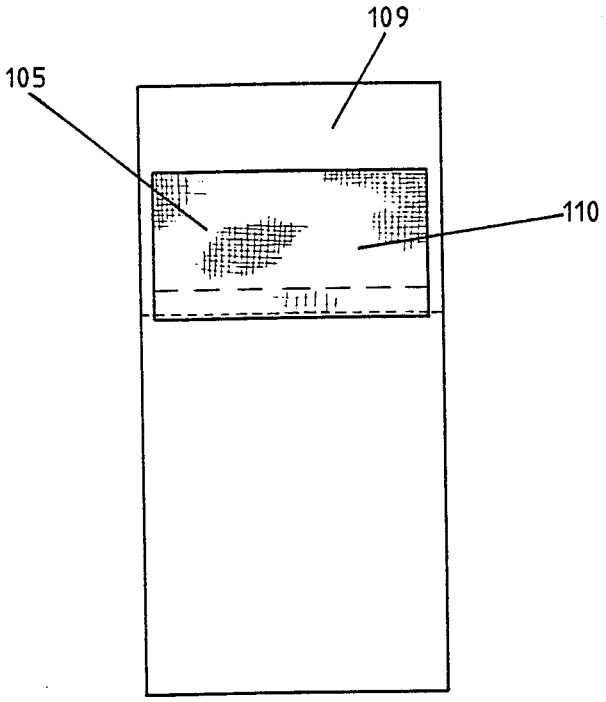
FIG. 16 shows another use of the invention, to make a blank 109 of any desired shape with a folded and sewn-on strip of cloth 110.

The manner of operation of the sewing unit of the invention will now be described. It will be assumed in this example that the sewing unit is being used for folding a pocket-trim strip 104 which is subsequently to be sewn on a blank of pocket bag 102, as shown in FIG. 15. It can also be used, for example, for folding a strip of cloth 110 and sewing it to a sewing material blank 109, as shown in FIG. 16.

Figure 7:
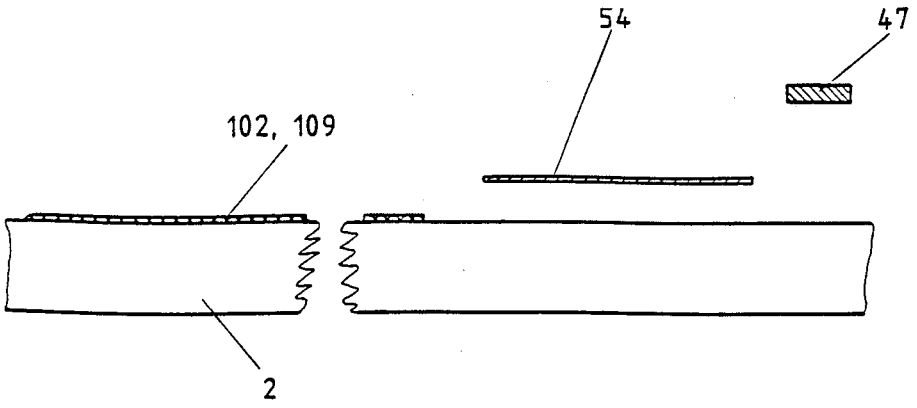
FIGS. 7 to 14 are each diagrams showing individual operating steps in the process of laying out two parts to be sewn, including a strip of cloth, and folding the strip of cloth, according to the disclosed embodiments.

By actuating a main switch 100 (FIG. 1) the sewing unit is turned on for operation. The feed device 8 at this time is in the region of a layout place 101, namely toward the rear (away from the operator) and in its raised position. According to FIG. 7, the operator now deposits the blank of the pocket bag 102 at the layout place 101 in accordance with the markings emitted by the marking lights 7 and imaged on the work table 2, or in the simplest case, in accordance with markings pasted onto the work table 2. A multi-stage foot switch 103 is now actuated for the first time. The corresponding cylinder space of the double-acting compressed-air cylinder 39 (FIG. 3) is acted upon, whereby its piston rod 40 is ejected in the forward direction—in the direction towards the operator. As a result, the beam 38, the carrier 44, and the counterplate 54 are displaced forward into a defined position.

Figure 8:
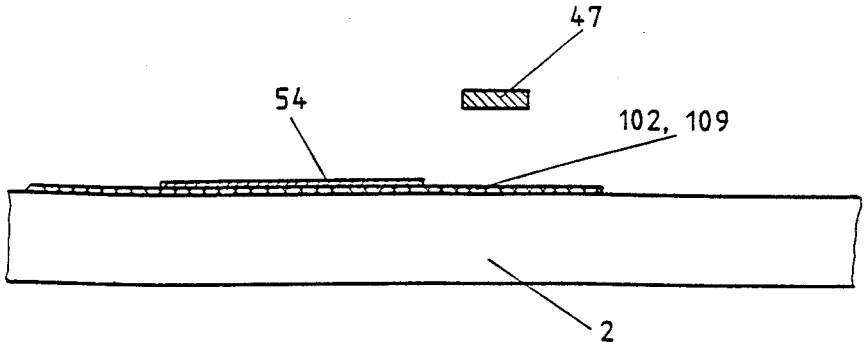

Then there is a second actuation of the foot switch 103. The corresponding cylinder spaces of the double-acting compressed-air cylinders 45 are acted on, whereby the carrier 44 is moved vertically downward until the bottom side of the counterplate 54 presses, according to FIG. 8, against the laid out pocket bag 102, and fixes it on the work table 2.

Figure 9:
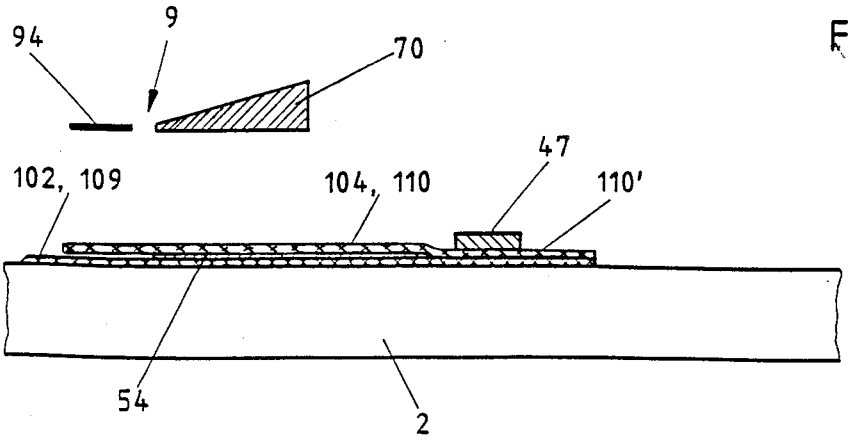

A pocket-trim strip 104 is now deposited in accordance with the markings onto the lowered counterplate 54 in such a manner that the front side 105 of the strip 104 (FIGS. 15, 16) faces upward and its longitudinal ends extend, according to FIG. 9, on both sides (front and back) beyond the counterplate 54.

Then there is a third actuation of the foot switch 103. The corresponding cylinder space of the double-acting compressed-air cylinder 51 is acted on, whereby the clamping unit 47 is lowered, according to FIG. 9, by rotating about the axis 48 onto a protruding part 110' of the pocket-trim strip 104. Now the pocket bag 102 and the pocket-trim strip 104 are fixed in proper position for sewing with respect to each other.

The corresponding cylinder space of the long-stroke cylinder 24 is acted on by compressed air, whereby the sliding carriage 32 is moved via the driven member 25 in the downstream direction toward the sewing machine 3. Thus, the feed device 8 and the parts to be sewn which are held clamped by it, namely the pocket bag 102 and the pocket-trim strip 104, are transferred from the layout place 101 to a transfer place 106.

In order to permit the smoothest possible transfer of the parts to be sewn, the top side of the work table 2 is provided in the transfer region with a large-area covering having a very smooth surface, the covering being preferably made of spring steel sheet. The application of such a friction-reducing covering has been practiced for many years on automatic sewing machines and sewing units, so that in this connection no further explanations are required in the text and drawings.

Figure 10:
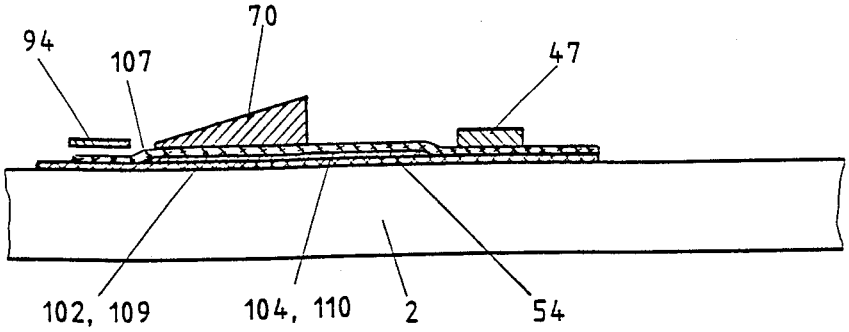

The previously mentioned transfer of the feed device 8 to the transfer place 106 is possible because the sewing-material holder 9 is at this time—as can be noted from FIGS. 1 and 9—in its raised position. When the feed device 8 has reached its end position in the region of the transfer place 106, the corresponding cylinder space of the double-acting compressed-air cylinder 68 (FIG. 2) is acted on, whereby the sewing-material holder 9 is lowered via the driver 63 onto the parts 102, 104 to be sewn, which have now been laid out at the transfer place 106 (see FIG. 10). The sewing-material holder 9 is now located between the two extension arms 53 of the feed device 8, and the clamping unit 47 is located in a space which is defined by the corresponding rear side of the supporting beam 74 of the sewing material holder 9, and by the two compressed-air cylinders 81 attached to said beam.

Figure 11:
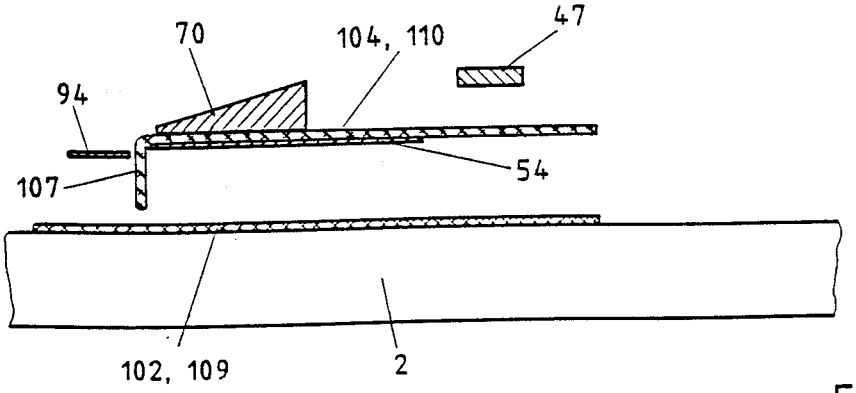

The clamping unit 47 is thereupon pivoted into its upper position by a corresponding action on the compressed-air cylinder 51 and, at the same time, the carrier 44 and with it the counterplate 54 are brought into the upper position shown in FIG. 11, by corresponding action on the two compressed-air cylinders 45. Together with the raising of the counterplate 54 which has just been described, the sewing-material holder 9 and with it the rail 70 are also brought by corresponding action on the compressed-air cylinder 68 into the upper position shown in FIG. 11, so that the pocket-trim strip 104 is still held clamped between the rail 70 and the counterplate 54.

Then, by action on the two single-acting compressed-air cylinders 77 which form part of the sewing-material holder 9, the levers 87 and with them the folding-plate 94 are swung slightly in counterclockwise direction until the top side of the folding-plate 94 is located below the bottom side of the counterplate 54. According to FIG. 11, a front edge region 107 of the pocket-trim strip 104 which protrudes forward from the counterplate 54 is in this way tilted downward.

Figure 12:
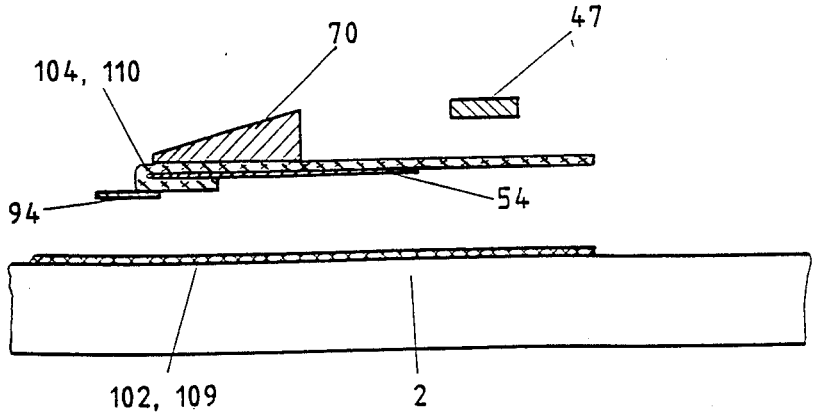

The supporting beam 74 and therefore also the folding-plate 94 are thereupon moved horizontally toward the rear by action on the corresponding cylinder space of the two compressed-air cylinders 81, whereby the pocket-trim strip 104 is folded, as shown in FIG. 12.

Figure 13:
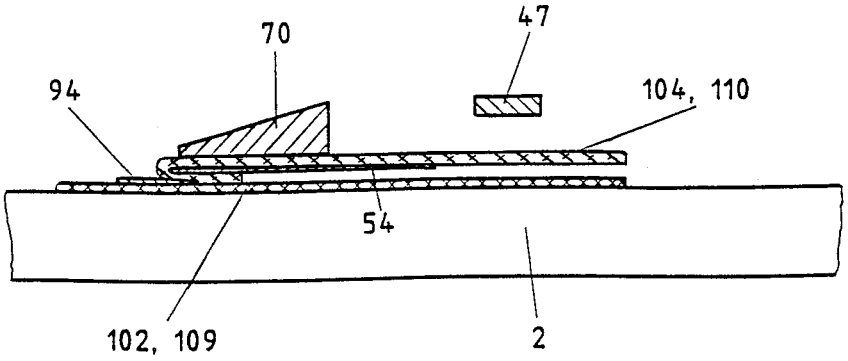
Figure 14:
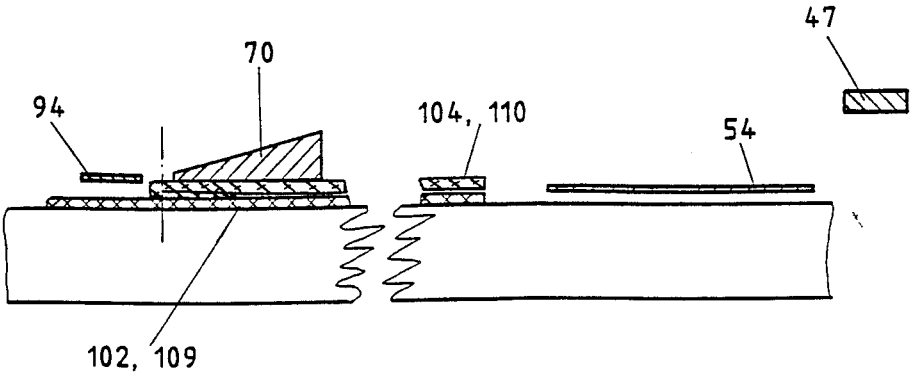

Then, as shown in FIG. 13, the sewing-material holder 9 together with the counterplate 54 of the feed device 8 are again lowered onto the pocket bag 102 which is still in the transfer position 106, the pocket bag being held on the work table 2 secured against displacement by known holding means, for example by vacuum suction. By action on the corresponding cylinder space of the compressed-air cylinder 39, the counterplate 54 is thereupon pulled back into the rear position shown in FIG. 14. The folding-plate 94 is brought by corresponding action on the compressed-air cylinders 81 and 77 into its starting position, also shown in FIG. 14.

Then, the counterplate 54 is brought into its upper position by corresponding action on the two compressed-air cylinders 45, and substantially at the same time, the corresponding cylinder space of the long-stroke cylinder 24 is acted upon by compressed air, whereby the sliding carriage 32 and with it the feed device 8 are now again moved into the starting position in the region of the layout place 101.

Once the counterplate 54 has been moved rearward from the region of the now folded pocket-trim strip 104, as described above, the clamp 58 (FIG. 2) is closed, thereby coupling the carriage 55 to the toothed belt 21 of the traction transmission 22, whereby the sewing-material holder 9 moves the clamped parts to be sewn, namely the pocket bag 102 and the folded pocket-trim strip 104, along to a sewing place 108 at the sewing machine 3. As a result of this displacement, the folded pocket-trim strip 104 can now be sewn on the pocket bag 102.

Then, the sewing-material holder 9 transports both parts which have been sewn together (see FIG. 15) to a storage place 111. The storage place 111 preferably is within the region of operation of a suitable small-parts conveyor, not shown or described here, which, in turn, causes the finished sewn parts to be fed to a suitable stacking device. By corresponding action on the compressed-air cylinder 68, the sewing-material holder 9 is thereupon raised, and simultaneously the clamp 58 is opened and the long-stroke cylinder 28 is acted on by compressed air, whereby the sewing-material holder 9 is returned to the transfer place 106.

From the above-described manner of operation it can be noted that the pocket bag 102 intended for the next work cycle can be laid out at the layout place 101 as soon as the feed device 8 has left the region of the layout place 101, and moved toward the transfer place 106.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of folding a strip of cloth in position for subsequently being sewn on a blank, comprising the steps of:

laying out both parts to be sewn in accordance with markings, prior to the folding, at a layout place upstream from a sewing machine, with respect to the direction of transport of the material to be sewn;

after the layout, bringing the blank and the unfolded strip of cloth, which partially contact each other, in fixed association with each other and with the front side of the strip of cloth facing upward, from the layout place to a transfer place, by means of a feed device, and locating the feed device below a raised sewing-material holder which is disposed at said transfer place;

lowering the sewing-material holder onto the strip of cloth, the blank, and a counterplate of the feed device;

raising the strip of cloth from the blank and folding an edge region of the strip of cloth downward by the cooperation of a folding-plate of the sewing-material holder with the counterplate;

lowering the folded strip of cloth again onto the blank;

removing the counterplate and the folding-plate from the folded strip of cloth;

transporting the feed device from the transfer place to the layout place; and transporting the sewing-material holder from the transfer place to a storage place.

2. A sewing unit for carrying out the method according to claim 1, which comprises:

a frame with a work table fastened thereon;

a sewing-machine, a sewing drive, and a marking device for guiding the laying out of the parts to be sewn in a manner suitable for sewing, attached to said work table;

means for fixing the position of the laid-out parts to be sewn with respect to each other for folding the strip of cloth and for holding the folded strip of cloth and the underlying blank together and transporting the same to a place for sewing, and then to a storage place.

3. A sewing unit as in claim 2, wherein said means comprises a feed device, which can be moved by a first linear drive along a first guide rod from said layout place to said transfer place.

4. A sewing unit as in claim 3, wherein said feed device includes a horizontally and vertically moveable counterplate and with a clamping unit which can be moved in synchronism with the latter about an axis which is parallel to said first guide rod.

5. A sewing unit as in claim 3, wherein said means comprises a carriage, which can be moved by means of a second linear drive along a third guide rod, and a sewing-material holder connected thereto and raisable and lowerable by a pivotable driver on said carriage, and a folding-plate which is arranged on the sewing-material holder and movable to an upper position, a lower position, and a back position 6. A sewing unit as in claim 5, wherein:

the first linear drive includes a long-stroke cylinder which is mounted fixed on the frame, is actuable by a pressure fluid, and is operatively connected to the feed device via a driven member; and the second linear drive includes a traction transmission, which is operatively connected to the sewing drive, and a second long-stroke cylinder which is mounted fixed on the frame and is actuable by a pressure fluid, the carriage being driven alternatively by the traction transmission and the long-stroke cylinder.

7. A sewing unit as in claim 5, wherein:

the first linear drive includes a traction transmission driven by a motor, the traction transmission being operatively connected to the feed device; and the second linear drive includes a further traction transmission driven by a further motor, this traction transmission being operatively connected to the carriage.

8. A sewing unit as in claim 7, wherein at least one of said motors is a frequency-controlled gear motor.

9. A sewing unit as in claim 7, wherein at least one of said motors is a stepper motor.

10. A sewing unit as in claim 4, wherein the feed device comprises a sliding carriage, a beam movable horizontally with respect thereto, and a carrier movable vertically with respect to said beam, the counterplate being attached to the carrier via two extension arms.

11. A sewing unit as in claim 6, further comprising:

a clamp which is actuable by an external force and which is provided on the carriage for releasably coupling the carriage to the traction transmission; and a driven member by which the carriage is operatively connected to the long-stroke cylinder.

12. A sewing unit as in claim 5, wherein the sewing-material holder comprises a rail, a supporting beam displaceable relative to said rail, and the folding-plate which is mounted pivotally on two levers, each lever being, in turn, pivotable on one transverse side of the supporting beam.

* * * * *